US009315247B2

(12) United States Patent
Hussey et al.

(10) Patent No.: US 9,315,247 B2
(45) Date of Patent: Apr. 19, 2016

(54) WATERPROOF RELIEF OUTLET

(71) Applicant: Zhik Pty Ltd, Artarmon, New South Wales (AU)

(72) Inventors: Thomas Kenneth Hussey, Balmain (AU); Bartosz Milczarczyk, Lane Cove (AU); Andrue Kerr, Revesby Heights (AU)

(73) Assignee: Zhik Pty Ltd (AU)

( * ) Notice: Subject to any disclaimer, the term of this patent is extended or adjusted under 35 U.S.C. 154(b) by 0 days.

(21) Appl. No.: 14/592,251

(22) Filed: Jan. 8, 2015

(65) Prior Publication Data

US 2015/0191232 A1 Jul. 9, 2015

(30) Foreign Application Priority Data

Jan. 8, 2014 (AU) ..... 2014900051

(51) Int. Cl.
*B63C 11/04* (2006.01)

(52) U.S. Cl.
CPC ..... *B63C 11/04* (2013.01); *B63C 2011/046* (2013.01)

(58) Field of Classification Search
CPC ..... B63C 11/04; A41D 13/02; A41D 1/06; A41D 13/012
USPC ..... 2/2.15, 79, 227, 234, 82, DIG. 5
See application file for complete search history.

(56) References Cited

U.S. PATENT DOCUMENTS

| | | | | |
|---|---|---|---|---|
| 291,854 | A * | 1/1884 | Platt | 2/82 |
| 2,570,019 | A * | 10/1951 | Wolk | 2/2.15 |
| 2,853,758 | A * | 9/1958 | Topf | 24/389 |
| 4,274,159 | A | 6/1981 | Schmidt | |
| 5,210,879 | A * | 5/1993 | Miller | 2/82 |
| 6,438,757 | B1 | 8/2002 | Quinn | |

* cited by examiner

*Primary Examiner* — Tejash Patel
(74) *Attorney, Agent, or Firm* — Whitmyer IP Group LLC

(57) ABSTRACT

A relief outlet in a wetsuit that is optionally substantially watertight consisting of a foldable funnel made of an elastic and optionally watertight material. Whereby said funnel is open at one and folded at least 1 time to close the opening when not in use.

24 Claims, 4 Drawing Sheets

WATERPROOF RELIEF OUTLET

FIELD OF THE INVENTION

The present invention relates to a wetsuit intended for marine sports such as sailing, sail boarding, surfing, paddling diving and so on.

BACKGROUND OF THE INVENTION

Wetsuits are sportswear that are used by individuals to provide thermal insulation during participation in watersports such as sailing, sail boarding, surfing, paddling diving and so on. Wetsuits are traditionally made from a material consisting of neoprene or other closed cell foam or other substantially liquid impermeable substrate with high stretch laminated to a textile. Said material is generally sewn or bonded into a tight fitting garment that conforms to the users body and has the ability to stretch and flex according the users movements.

Wetsuits may be constructed as to provide a substantially watertight construction that prevents the ingress of a substantial amount of water during normal use. Other designs and methods of construction may also allow a reasonable flow of water through the suit.

An inherent problem with most wetsuits is the difficulty of removing the suit during use to urinate. While it is known in the art to provide a VELCRO or zippered relief opening on the crotch area, there is a need to provide a more durable relief opening that exhibits good stretch and comfort while also allow easy access during sporting activities. In a further aspect, there is a need to provide a substantially watertight seal to allow for use in watertight wetsuits.

SUMMARY OF THE INVENTION

The present invention discloses a relief outlet in a wetsuit that is optionally substantially watertight. Said relief outlet consists of a foldable funnel made of an elastic and optionally watertight material. Said funnel is open at one end and secured around the circumference of the second opening to said wetsuit. Said funnel is folded at least 1 time to close the opening when not in use and is secured by means of a covering flap or other retaining device secured to said wetsuit.

DETAILED DESCRIPTION OF THE INVENTION

The present invention discloses a relief outlet in a wetsuit made from a substantially watertight textile or rubber material or composite thereof. Said relief outlet consists of a foldable funnel preferably made from a flexible elastic and optionally rubber material fixed at one end to the crotch area of the said wetsuit and open at the opposite end. Said funnel is folded at least 1 time to close said opening and secured by optional covering flap or other retaining device.

In a preferred embodiment said wetsuit is constructed from a material that consists of an elastic closed cell foam such as neoprene or other foam rubber that is optionally laminated to at least one textile. Said material is preferably combined together by means of stitching, gluing or taping or combination of these processes and may be configured to substantially water and air impermeable or water and/or air permeable. In an alternative embodiment said material could consist of a substantially watertight and air permeable membrane laminated to a textile.

Figure 1D:
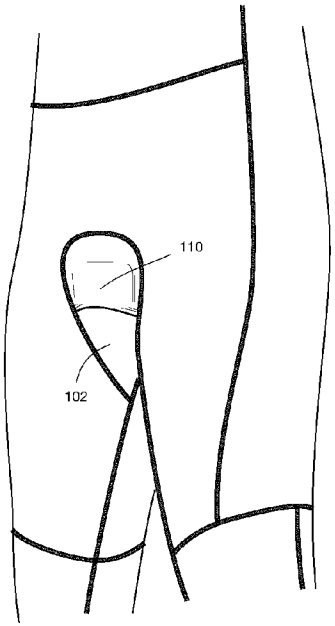
FIG. 1*d* is a front view of the crotch area of a wetsuit with a funnel folded in the closed position and covered by funnel retaining flap.
Figure 1C:
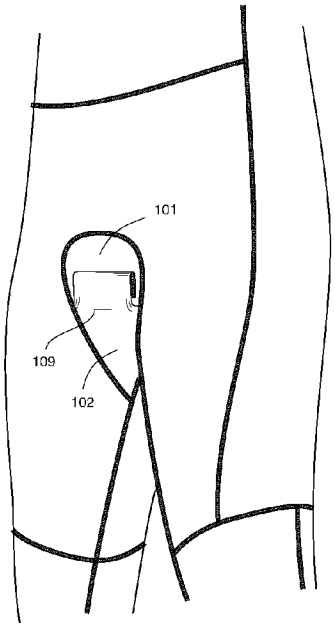
FIG. 1*c* is a front view of the crotch area of a wetsuit with a funnel folded in the closed position. Funnel retaining flap is omitted for clarity.
Figure 1B:
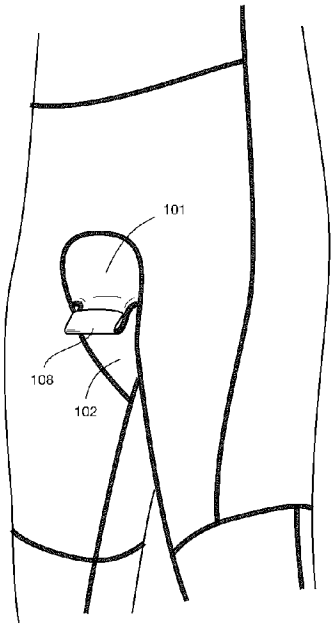
FIG. 1*b* is a front view of the crotch area of a wetsuit with a funnel folded one time. Funnel retaining flap is omitted for clarity.
Figure 1A:
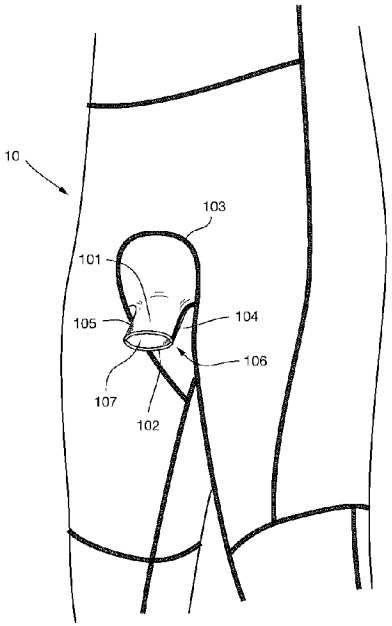
FIG. 1*a* is a front view of the crotch area of a wetsuit with an extended funnel in the open position. Funnel retaining flap is omitted for clarity.
Figure 2C:
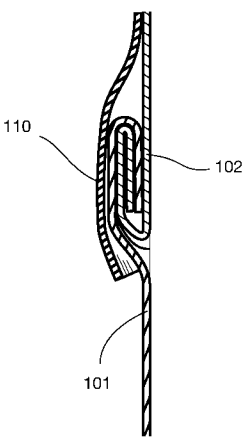
FIG. 2*c* is a cross section view of relief outlet with funnel folded in closed position and secured by funnel retaining flap.
Figure 2B:
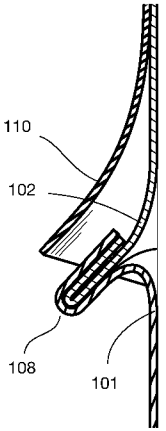
FIG. 2*b* is a cross section view of relief outlet with funnel folded one time.
Figure 2A:
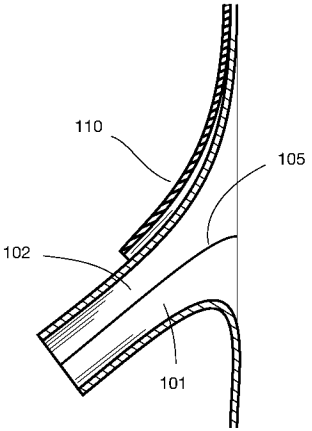
FIG. 2*a* is a cross section view of relief outlet with extended funnel in open position.

A preferred embodiment of the present invention is shown in FIG. 1*a* whereby wetsuit 10 features a top crotch panel 101 and bottom crotch panel 102. Top crotch panel 101 and bottom crotch panel 102 are combined along seams 104 and 105 to form a funnel 106 with opening 107 and are joined to wetsuit 10 along seam 103.

Said crotch panels are preferably made from a neoprene textile composite, latex rubber, textile or other material and may be bonded at seams 104 and 105 by means of gluing, stitching, taping or other method.

In a preferred embodiment said seams 104 and 105 are constructed to be watertight by means of gluing and blind-stitching said panels whereby the cut edge of said closed cell foam panels are glued together and a blind stitch that does not pierce through the thickness of the material is used to reinforce said glued seam.

In another preferred embodiment said seams are reinforced by the additional of a hot-melt or hand glued tape consisting of a polyurethane film or thin neoprene film.

In a preferred embodiment as shown FIGS. 1*b*, 1*c* and 1*d* funnel 106 is folded along edge 108 and 109 before being secured under cover flap 110. Said folds provide a watertight closure preventing the ingress of water through opening 107. Said cover flap may include a method for further retaining said folded funnel such as the use of hook and loop VELCRO, press button, snap fixture, magnet, zipper or other method. In another alternative embodiment said cover flap may be substituted by another form of securing means such as an elastic strap, hook and loop VELCRO tab or strap or other method known in the art.

In a preferred embodiment of the present invention, said crotch panels 101 and 102 may feature a smoothskin neoprene, latex rubber, silicon, silicon printed textile or other surface on the inner side of said panels that provide an improved watertight seal when funnel 106 is folded.

In another preferred embodiment, said crotch panels may consist of 2 or more separate panels combined together as to provide a thinner material thickness in the funnel area of the panel.

In another preferred embodiment of the present invention, a single panel may stitched and/or molded to create said funnel instead of combining two or more separate panels.

Figure 3C:
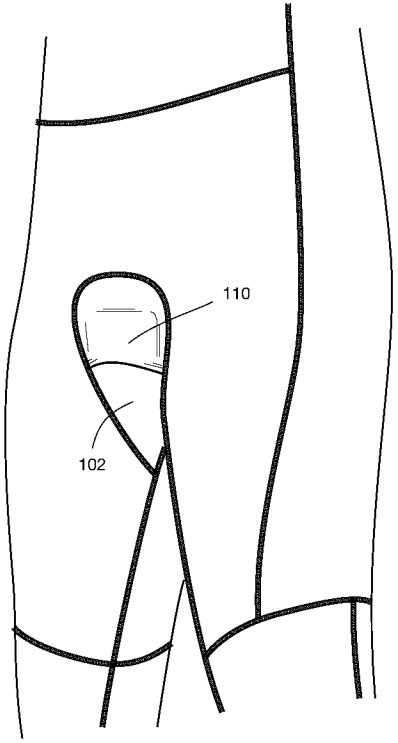
FIG. 3*c* is a front view of the crotch area of a wetsuit with a funnel folded in the closed position and covered by funnel retaining flap.
Figure 3B:
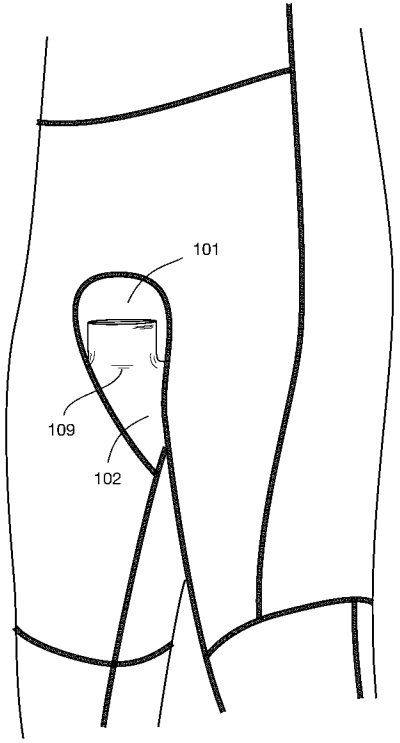
FIG. 3*b* is a front view of the crotch area of a wetsuit with a funnel folded one time in the closed position. Funnel retaining flap is omitted for clarity.
Figure 3A:
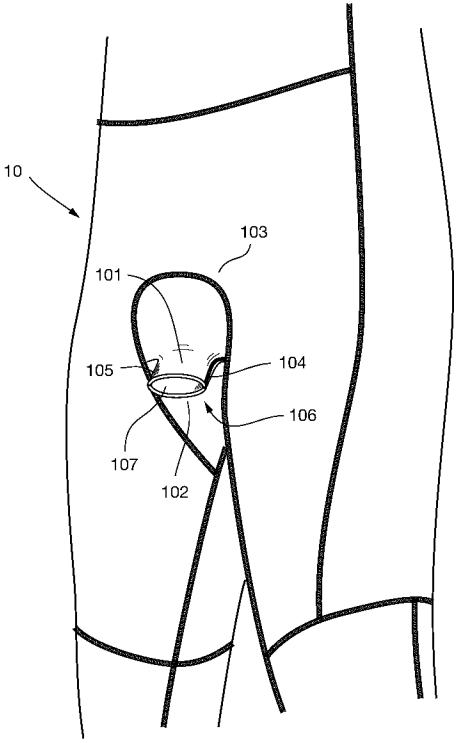
FIG. 3*a* is a front view of the crotch area of a wetsuit with an extended funnel in the open position. Funnel retaining flap is omitted for clarity.
Figure 4B:
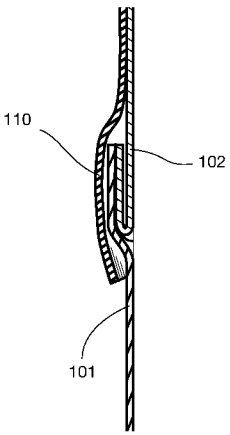
FIG. 4*b* is a cross section view of relief outlet with funnel folded one time in closed position and secured by funnel retaining flap.
Figure 4A:
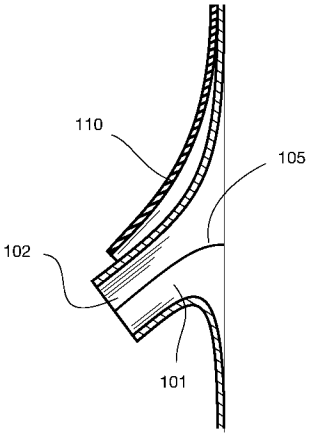
FIG. 4*a* is a cross section view of relief outlet with extended funnel in open position.

In an alternative embodiment shown in FIGS. 3*a, b, c* and 4*a* and *b*, said funnel 106 is folded one time at 108 to provide a more simple closure method that is easier to access by the user.

What is claimed is:

1. A wetsuit having a relief outlet, the wetsuit comprising:

a foldable funnel having a first end fixed to a body-conforming crotch area of said wetsuit and a second end, said funnel being foldable at least one time to close said relief outlet, said second end being open when the funnel is in a folded state; and a covering flap operable to at least partly cover said funnel.

2. The wetsuit according to claim 1, wherein said relief outlet is substantially watertight when closed.

3. The wetsuit according to claim 1, wherein said funnel comprises a top panel and a bottom panel that are joined by at least one seam.

4. The wetsuit according to claim 3, wherein said top panel and said bottom panel are joined by a first seam and a second seam.

5. The wetsuit according to claim 4, wherein said funnel is foldable along an edge that is perpendicular to said first seam and said second seam.

6. The wetsuit according to claim 5, wherein said edge is a first edge and said funnel is foldable a second time along a second edge that is perpendicular to said first seam and said second seam.

7. The wetsuit according to claim 1, wherein said wetsuit is comprised of a sustainably watertight and moisture vapour permeable substrate and textile composite.

8. The wetsuit according to claim 1, wherein said funnel is comprised of an elastic material comprising a textile.

9. The wetsuit according to claim 1, wherein said funnel is comprised of an elastic material comprising a closed cell foam.

10. The wetsuit according to claim 9, wherein said closed cell foam is neoprene.

11. The wetsuit according to claim 1, wherein said funnel is comprised of a substantially watertight and moisture vapour permeable substrate and textile composite.

12. The wetsuit according to claim 1, wherein said funnel is comprised of an elastic material that is substantially watertight.

13. The wetsuit according to claim 12, wherein said elastic material is a latex, neoprene, natural rubber or composite thereof.

14. The wetsuit according to claim 3, wherein said at least one seam is constructed using stitching, blind stitching, gluing or taping or combination thereof so that the seams are substantially watertight.

15. The wetsuit according to claim 1, wherein said funnel is constructed by means of injection moulding, compression moulding or dipping.

16. The wetsuit according to claim 1, wherein said funnel comprises a smooth-skin neoprene foam or rubber on one or more inside surfaces to improve the watertight seal.

17. The wetsuit according to claim 1, wherein said covering flap secures the said folded funnel by means of hook and loop material.

18. The wetsuit according to claim 1, wherein said covering flap secures the said folded funnel by means of a zipper.

19. The wetsuit according to claim 1, wherein said covering flap secures the said folded funnel by means of a press stud or button.

20. The wetsuit according to claim 1, wherein said covering flap secures the said folded funnel by means of at least one magnet.

21. The wetsuit according to claim 1, wherein said wetsuit is comprised of an elastic material comprising a textile.

22. The wetsuit according to claim 1, wherein said wetsuit is comprised of an elastic material comprising a closed cell foam.

23. The wetsuit according to claim 22, wherein said closed cell foam is neoprene.

24. The wetsuit according to claim 1, wherein said funnel comprises at least three panels of material.

* * * * *